US006250888B1

(12) United States Patent
Popov et al.

(10) Patent No.: US 6,250,888 B1
(45) Date of Patent: Jun. 26, 2001

(54) PUMPING-EJECTOR UNIT AND PROCESS THEREFOR

(76) Inventors: Serguei A. Popov, 4615 Post Oak Pl., Suite 140, Houston, TX (US) 77027; Anatoli M. Doubinski, Flat 96, 6, Volokolamskoe Shosse, Moscow, 125080 (RU)

( * ) Notice: Subject to any disclaimer, the term of this patent is extended or adjusted under 35 U.S.C. 154(b) by 0 days.

(21) Appl. No.: 09/402,045

(22) PCT Filed: Jan. 26, 1999

(86) PCT No.: PCT/IB99/00133

§ 371 Date: Sep. 27, 1999

§ 102(e) Date: Sep. 27, 1999

(87) PCT Pub. No.: WO99/37926

PCT Pub. Date: Jul. 29, 1999

(30) Foreign Application Priority Data

Jan. 27, 1998 (RU) ..... 98101479

(51) Int. Cl.[7] ..... F04B 19/24; F04F 5/00; F04F 5/44

(52) U.S. Cl. ..... 417/54; 417/53; 417/151; 417/196; 417/198

(58) Field of Search ..... 417/54, 151, 196, 417/198, 53, 57

(56) References Cited

U.S. PATENT DOCUMENTS

| | | | | |
|---|---|---|---|---|
| 3,200,764 | * | 8/1965 | Saunders, Jr. | 417/185 |
| 4,673,335 | * | 6/1987 | Nicodemus | 417/54 |
| 5,087,175 | * | 2/1992 | Raizman et al. | 417/196 |
| 5,338,113 | * | 8/1994 | Fissenko | 366/177 |
| 5,343,711 | * | 9/1994 | Kornhauser et al. | 417/198 |
| 5,544,961 | * | 8/1996 | Fuks et al. | 366/163.2 |
| 6,016,840 | * | 1/2000 | Popov et al. | 417/196 |

FOREIGN PATENT DOCUMENTS

| | | |
|---|---|---|
| 2016262 | 7/1994 | (RU) . |
| 2091117 | 9/1997 | (RU) . |
| 559098 | 7/1977 | (SU) . |
| 866298 | 9/1981 | (SU) . |
| 1588925 | 8/1990 | (SU) . |
| 1733714 | 5/1992 | (SU) . |

OTHER PUBLICATIONS

Sokolov E.Y., "Jet Apparatuses" book, 1970, USSR, Moscow, "Energy" Publishing house, pp. 214, 215.

* cited by examiner

*Primary Examiner*—Charles G. Freay
*Assistant Examiner*—Michael K. Gray
(74) *Attorney, Agent, or Firm*—Mark A. Oathout

(57) ABSTRACT

The invention pertains to the field of jet technology and relates to an operating process which essentially includes feeding of a gas-liquid flow from an ejector into a chamber for supersonic flow conversion, where the gas-liquid flow is exposed to an abrupt expansion and, because of a reduction to the gas-liquid flow's density, a sonic or supersonic flow regime is provided. Further, the gas-liquid flow is slowed down by a pressure jump. The invention also relates to a device for realizing this process which essentially includes a pumping-ejector unit furnished with a chamber for supersonic flow conversion. The inlet of the chamber is connected to the ejector's outlet, the chamber's outlet is connected to a separator. The chamber for supersonic flow conversion defines a shaped cavity, diverging stepwise in the flow direction. The described operating process and related pumping-ejector unit ensures more reliable operation.

11 Claims, 3 Drawing Sheets

PUMPING-EJECTOR UNIT AND PROCESS THEREFOR

BACKGROUND

The invention pertains to the field of jet technology, primarily to pumping-ejection units for producing a vacuum and for compression of gaseous mediums.

An operating process of a pumping ejector system is known, which consists of delivery of a liquid medium under pressure into the nozzle of a liquid-gas ejector by a pump, forming of a liquid jet at the outlet of the nozzle and evacuation of a gaseous medium by this jet, mixing of the liquid and the gaseous mediums and obtaining a gas-liquid stream, discharge of the gas-liquid stream from the ejector into drainage (see "Jet Apparatuses", book of E. Y. Sokolov, N. M. Zinger, "Energia" Publishing house, Moscow, 1970, pages 214–215).

The same book introduces a pumping ejector system having a pump and a liquid-gas ejector, wherein the pump is connected by its discharge side to the ejector's nozzle, the ejector's inlet of the passive gaseous medium is connected to a source of the evacuated medium and the ejector's outlet is connected to drainage.

The described operating process and system for its embodiment have not found wide industrial application because discharge of the gas-liquid mixture into [the] drainage often results in environmental pollution and the system's operation requires high consumption of a liquid medium. The latter makes the system economically unattractive.

The closest analogue of the operating process introduced by the present invention is an operating process of a pumping-ejector unit, which includes delivery of a liquid medium from a separator into the nozzle, or several nozzles, of a liquid-gas ejector by a pump, evacuation of a gaseous medium by a jet of the liquid motive medium, mixing of the mediums in the ejector and forming of a gas-liquid flow with simultaneous compression of the gaseous medium (see RU, patent, 2091117, cl. B 01 D Mar. 10, 1997).

The same RU patent also describes a pumping-ejector unit for embodiment of the process. It includes a separator, a pump and a liquid-gas ejector. The liquid inlet of the ejector is connected to the discharge side of the pump and the gas inlet of the ejector is connected to a source of an evacuated gaseous medium.

With this operational process and related pumping-ejector unit it is possible to reduce energy consumption because the liquid-gas ejector is placed at a height of 5 to 35 meters above the separator and thus provides utilisation of gravitational forces in the delivery pipe connecting the ejector and separator.

But together with this positive effect such a design also has a significant imperfection concerned with the fact, that a high-altitude position of the jet apparatus and a long delivery pipe provokes a jump of the gas-liquid flow's speed in the delivery pipe. As a result, speed of the gas-liquid flow at the separator's inlet, where a hydroseal is made, can reach hundreds of meters per second. Therefore there is a necessity to reinforce those elements of the separator which react to the increased load generated by the high-speed flow. This leads to an increase in the separator's dimensions and specific consumption of materials.

SUMMARY OF THE INVENTION

The present invention is aimed at improving reliability of a pumping-ejector unit, which can be achieved by adjusting the flow speed at the inlet of a separator regardless of spatial positioning of a liquid-gas ejector (horizontal or vertical) and regardless of the ejector's altitude above the separator.

The solution of above mentioned problem is provided by an operating process of a pumping-ejector unit, which includes delivery of a liquid medium from a separator to the nozzle, or several nozzles, of a liquid-gas ejector by a pump, evacuation of a gaseous medium by a jet of the liquid motive medium flowing from the ejector's nozzle, mixing of the mediums in the ejector and forming of a gas-liquid flow with the simultaneous compression of the gaseous medium, feeding of the gas-liquid flow from the ejector into a chamber for supersonic flow conversion, where the gas-liquid flow is exposed to abrupt expansion in a shaped canal in order to reduce the density of the gas-liquid flow down to a predetermined value and to provide a flow speed which is not lower than the sonic speed in this gas-liquid flow, subsequent passing of the flow through another shaped canal where it is slowed down to a predetermined speed by means of a pressure jump, and feeding of the decelerated gas-liquid flow into the separator, where compressed gas is separated from the liquid motive medium.

In order to achieve the design speed of the flow at the separator's inlet the unit can be furnished with several chambers for supersonic flow conversion providing several cycles of flow expansion and subsequent deceleration to a subsonic speed through a pressure jump. Thus gradual braking of the flow is ensured. Subject to design of the separator it is expedient to slow the gas-liquid flow down to 4.6 to 450 m/sec.

With regard to the apparatus as the subject-matter of the invention, the mentioned technical problem is solved as follows: a pumping-ejector unit including a separator, a pump connected by its suction side to the separator, and a liquid-gas ejector, whose liquid inlet is connected to the discharge side of the pump and gas inlet is connected to a source of an evacuated gaseous medium, is furnished additionally with a chamber for supersonic flow conversion. An inlet of this chamber is connected to the ejector's outlet, the chamber's outlet is connected to the separator. The chamber constitutes a shaped canal diverging stepwise in the flow direction.

The Inlet of the chamber for supersonic flow conversion can be fastened to the outlet section of the ejector's mixing chamber. The outlet of the chamber for supersonic flow conversion can be fastened to the separator's inlet.

There is another variant of the design of the pumping-ejector unit, comprising a separator, a pump connected by its suction side to the separator, and a liquid-gas ejector, whose liquid inlet is connected to the discharge side of the pump and gas inlet is connected to a source of an evacuated gaseous medium. In this variant the unit is furnished with not less than one chamber for supersonic flow conversion, the inlet of the chamber (or chambers) for supersonic flow conversion is connected to the ejector's outlet, and the outlet of the chamber (or chambers) is connected to the separator. In this case the ejector has a multi-nozzle design and comprises a motive liquid distribution chamber with active nozzles at its outlet, a receiving chamber and mixing chambers coaxial to each nozzle.

Each mixing chamber can be furnished with its own chamber for supersonic flow conversion, the multi-nozzle ejector can be furnished with a discharge chamber installed at the outlet end of the mixing chambers, and in this case the chamber for supersonic flow conversion can be fastened directly to the outlet of the discharge chamber.

The chamber for supersonic flow conversion can be composed of two stepwise conjugated portions, with a ratio of the cross-sectional area of the downstream portion to the cross-sectional area of the upstream portion can range from 1.05 to 10, the length of the downstream duct can not be more than $\sqrt{12\,S}$, where S is the cross-sectional area of the upstream duct.

A pipe connected to the outlet of the chamber for supersonic flow conversion can have a uniform section, or it can be convergent with the taper angle up to 26° or divergent with the taper angle up to 5–60°. With regard to the shape of the cross-sections of the chamber for supersonic flow conversion and pipes, their shape has no vital importance and can be for example circular, oval, polyhedral etc.

Experimental research has shown, that backpressure at the ejector's outlet exerts significant influence on the liquid-gas ejector's performance. Therefore it was necessary to ensure deceleration of the flow prior to its entry into the separator without a significant increase of the backpressure.

It was found that the most successful way is to use energy of the gas-liquid flow itself for the deceleration and to make the deceleration system self-adjusting, i.e. if the flow speed is low the system does not significantly influence the flow regime, but if the flow speed increases and exceeds some predetermined level the system starts to decelerate the flow automatically. Thereto a chamber for supersonic flow conversion was developed, wherein the gas-liquid flow undergoes abrupt expansion in a stepwise diverging cavity. As a result of the gas-liquid flow's abrupt expansion the density of the flow abruptly drops, mainly due to the expansion of the flow's gaseous component. This results in reduction of the speed of sound in this gas-liquid flow and puts the flow into a sonic or supersonic regime. Then the flow moves into a pipe, whose cross-sectional area usually is equal to the surface area of the outlet cross-section of the chamber for supersonic flow conversion. However, the cross-sectional area of the pipe can be both larger and smaller than the area of the outlet cross-section of the chamber for supersonic flow conversion. The flow regime with a pressure jump is organized in the pipe installed behind the chamber for supersonic flow conversion. This pressure jump decelerates the gas-liquid flow and at the same time boosts pressure of the gas-liquid medium. If the gas-liquid flow's speed at the chamber's inlet is not high, density of the flow drops slightly over the expansion in the chamber and the flow is not transformed into the supersonic state but back into the subsonic state. Therefore in this case there is no significant flow deceleration.

In a number of cases, for example when the ejector is installed with the longest axis vertical, it is advisable to install several chambers for supersonic flow conversion. Experiments have shown that in such cases several chambers operate better than one chamber with significant single-stage enlargement, which can not provide deceleration of the flow to the rated speed ranging from 4.6 to 450 m/sec. In connection with this, it is not expedient to make the chamber for supersonic flow conversion with a ratio of the cross-sectional area of the first step portion to the cross-sectional area of the second step portion more than 10 and less than 1.05.

As to the location of the chamber (or chambers) for supersonic flow conversion, it is advisable to place the chambers evenly between the ejector's outlet and the separator's inlet. But when the ejector is installed at a low level or when the unit has a horizontal layout, it is advisable to install the chamber for supersonic flow conversion directly at the ejector's outlet or at the separator's inlet.

Thus, the described units implementing the described operating process provide a solution to the technical problem by, i.e. ensuring more reliable operation due to the adjustability of the gas-liquid flow speed.

DETAILED DESCRIPTION

Figure 1:
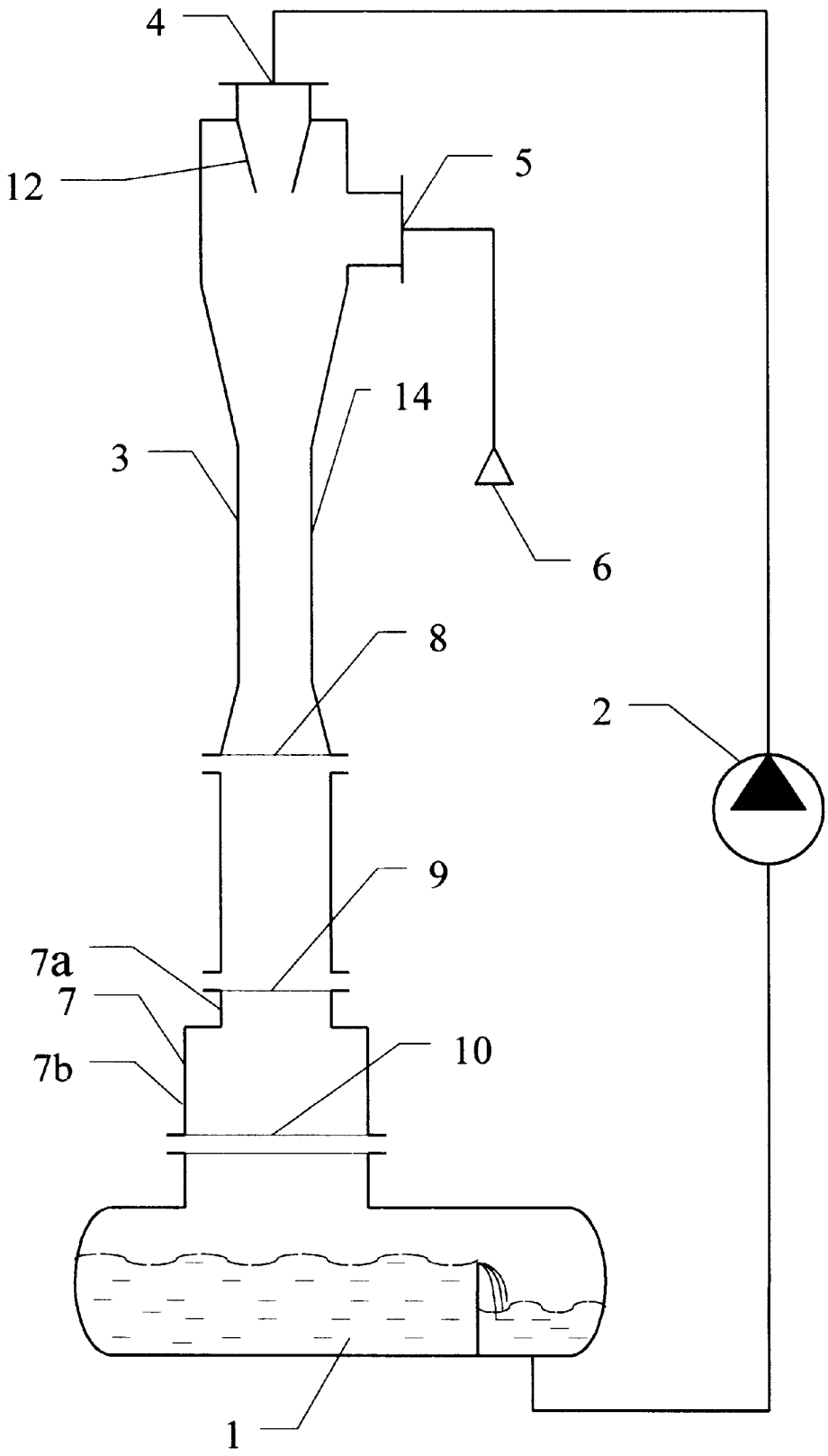
FIG. 1 represents a schematic diagram of a pumping-ejector unit with a single-nozzle ejector and with a chamber for supersonic flow conversion placed at some distance from both the ejector and a separator.

The Pumping-ejector unit (FIG. 1) includes a separator 1, a pump 2 whose suction side is connected to the separator 1, and a single-nozzle liquid-gas ejector 3 whose liquid inlet 4 is connected to the discharge side of the pump 2 and gas inlet 5 is connected to a source 6 of an evacuated gaseous medium. The unit is furnished with a chamber 7 for supersonic flow conversion. An Inlet 9 of the chamber 7 is connected to an outlet 8 of the ejector 3, an outlet 10 of the chamber 7 is connected to the separator 1. The chamber 7 for supersonic flow conversion defines a shaped cavity diverging stepwise in the flow direction.

The Inlet 9 of the chamber 7 for supersonic flow conversion can be fastened directly to the outlet 8 of the ejector's mixing chamber. The Outlet 10 of the chamber 7 for supersonic flow conversion can be fastened directly to the inlet of the separator 1.

Figure 2:
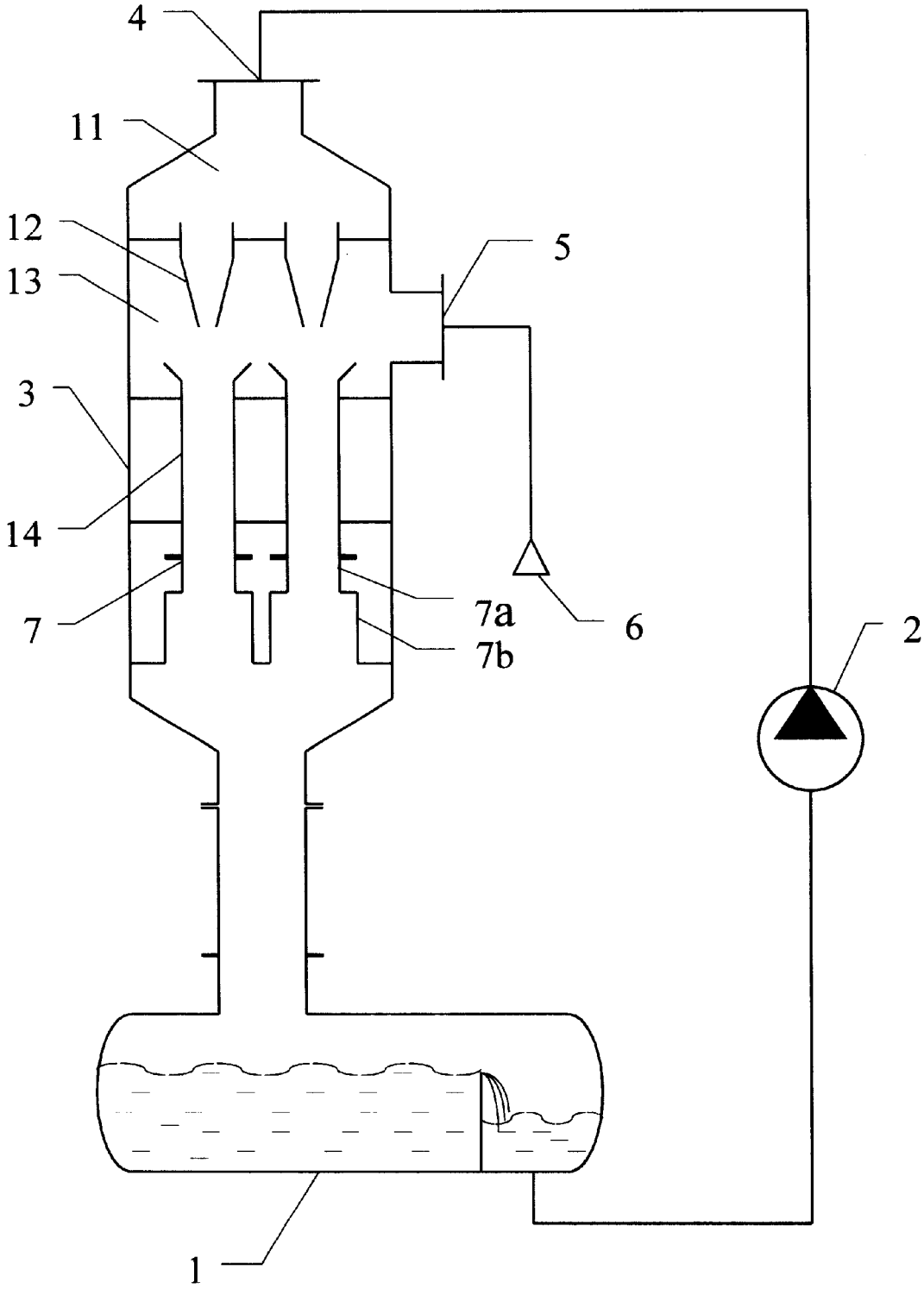
FIG. 2 represents a schematic diagram of a pumping-ejector unit with a multi-nozzle liquid-gas ejector and with chambers for supersonic flow conversion placed directly at the outlets of the ejector's mixing chambers.
Figure 3:
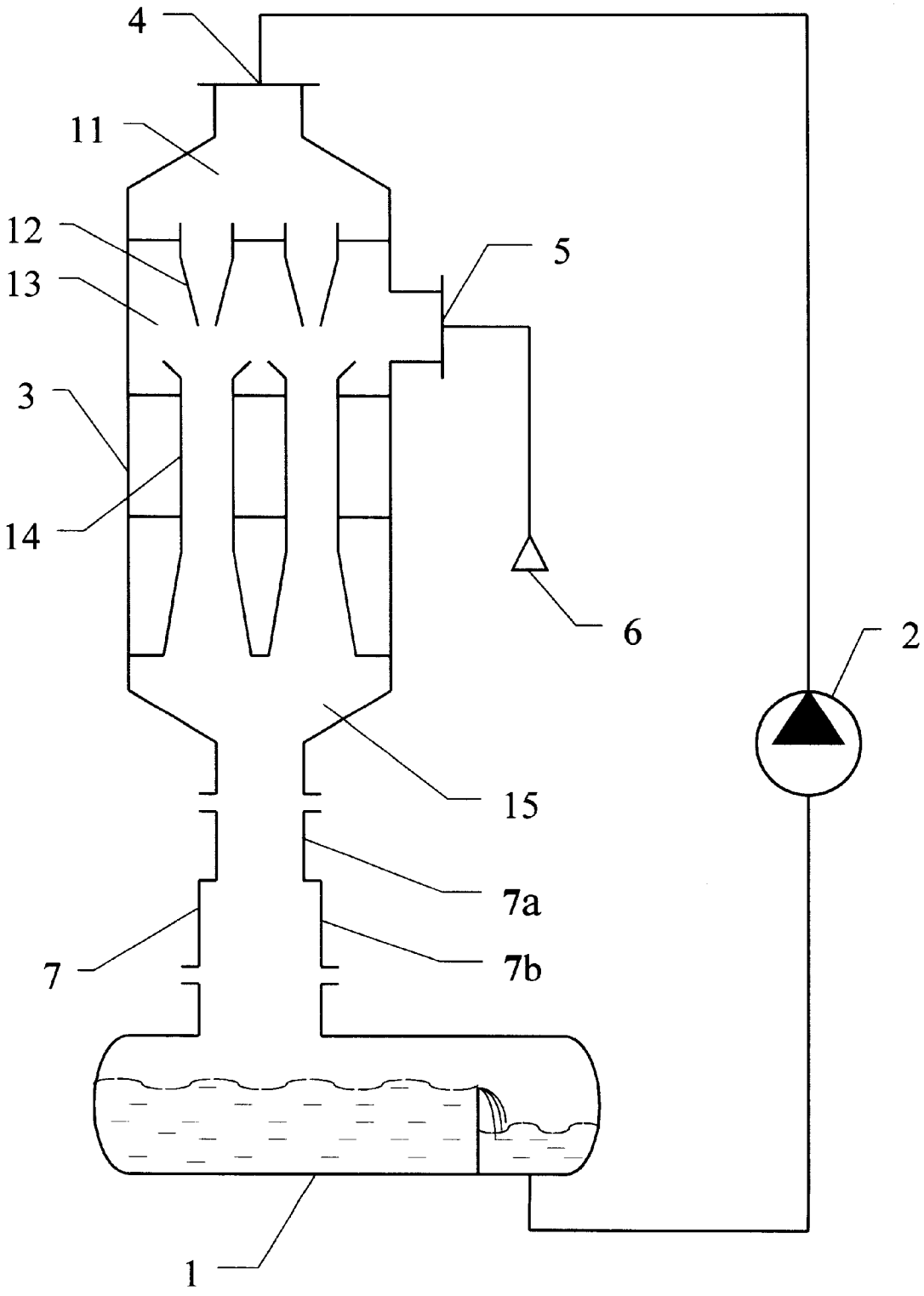
FIG. 3 represents a schematic diagram of a pumping-ejector unit with a chamber for supersonic flow conversion installed directly at the outlet of a discharge chamber of a multi-nozzle ejector.

There is another variant of the unit's design. In this varied embodiment the unit is furnished with a multi-nozzle liquid-gas ejector (FIG. 2 and FIG. 3). In this case the ejector 3 includes a chamber 11 of motive liquid distribution with active nozzles 12 at its outlet, a receiving chamber 13 and mixing chambers 14 which are coaxial to the nozzles 12.

Each mixing chamber 14 of the multi-nozzle ejector 3 can be furnished with its own chamber 7 for supersonic flow conversion (see FIG. 2).

The multi-nozzle ejector 3 can be furnished with a discharge chamber 15, installed at the outlets of the mixing chambers 14. In this case (see FIG. 3) the inlet of the chamber 7 for supersonic flow conversion can be fastened directly to the outlet of the discharge chamber 15 of the multi-nozzle ejector 3.

As to the chamber 7 for supersonic flow conversion, it essentially relates to a supersonic aerodynamic gap or an aerodynamic sluice. The chamber 7 for supersonic flow conversion is composed of two stepwise conjugated sections: a first step section 7*a* and a second step section 7*b*. The ratio of the cross-sectional area of the downstream section 7*b* to the cross-sectional area of the upstream section 7*a* ranges from 1.05 to 10, and the length of the second step section 7*b* is not more than $\sqrt{12\,S}$, where S is the cross-sectional area of the upstream or first step section 7*a* of the chamber 7.

The operating process of the pumping-ejector unit is realized as follows.

A Liquid motive medium from the separator 1 is delivered into the nozzle of the ejector 3 through its liquid inlet 4 by the pump 2. The liquid motive medium, flowing from the nozzle 12 of the ejector 3, evacuates a gaseous medium with subsequent forming of a gas-liquid flow in the mixing chamber 14 of the ejector 3. At the same time the evacuated gaseous medium undergoes compression under the impact of the motive liquid's energy. The liquid-gas medium from the ejector 3 flows into the chamber 7 for supersonic flow conversion, where the flow is exposed to an abrupt expansion in a shaped cavity defined by the chamber 7 diverging stepwise. Thus, a sonic or supersonic flow regime is ensured due to the drop in the gas-liquid flow's density after the expansion. Then the gas-liquid flow passes through the shaped cavity in chamber 7 in one case, from upstream section 7*a* and through the second step section 7*b* of the chamber 7 or the pipe connecting the outlet of the chamber 7 with the separator 1—subject to the location of the chamber 7), where the flow is decelerated (by a pressure jump) to the designed speed which ranges as a rule from 4.6 to 450 m/sec. The gas-liquid flow, additionally compressed by the pressure jump, is fed into the separator 1, where compressed gas is separated from the liquid motive medium.

The operating process of the unit with the multi-nozzle ejector 3 is implemented as follows: the liquid motive medium is fed through the distribution chamber 11 into several nozzles 12, and each jet of the motive liquid flows from the nozzle 12 into its respective mixing chamber 14. Subsequent transformations of the gas-liquid flow formed in the mixing chambers 14 can take place either in the separate chambers 7 for supersonic flow conversion, installed after each mixing chamber 14 (FIG. 2), or in the common chamber 7 (FIG. 3). In the case of the application of the common chamber 7, separate gas-liquid streams flowing from each of the mixing chambers 14 or from diffusers (if the latter exist in the ejector 3) are first collected in the discharge chamber 15 and then pass into the common chamber 7 for supersonic flow conversion.

If it is impossible to decelerate the gas-liquid flow to the designed speed in one chamber 7, several successive transformations of the flow with expansions of the gas-liquid into the supersonic regime with subsequent deceleration of the supersonic flow by a pressure jump may be provided by the implementation of several chambers 7.

Industrial Applicability

This invention can be applied in chemical, petrochemical and other industries.

What is claimed is:

1. An operational process for a pumping-ejector unit, comprising:

feeding a liquid motive medium from a separator into a nozzle of a liquid-gas ejector by a pump;

evacuating a gaseous medium by a jet of the liquid motive medium;

forming a gas-liquid flow in the liquid-gas ejector and simultaneously compressing the gaseous medium;

feeding and passing the gas-liquid flow into and through a chamber for supersonic flow conversion, including abruptly expanding the gas-liquid flow and providing at least a sonic flow regime by abruptly reducing the density of the gas-liquid flow, and further including slowing down the gas-liquid flow by a pressure jump; and feeding the slowed gas-liquid flow into a separator, where a compressed gas is separated from the liquid motive medium.

2. The operational process according to claim 1, further comprising successive feeding and passing of the gas-liquid flow into and through at least one additional chamber for supersonic flow conversion including abruptly expanding the gas-liquid flow into at least the sonic flow regime and slowing down the gas-liquid flow by a pressure jump.

3. The operational process according to claim 1, wherein the gas-liquid flow at an outlet of the chamber for supersonic flow conversion has a speed ranging from 4.6 to 450 m/sec.

4. A pumping-ejector unit, including a separator, a pump connected by one side to the separator, and a liquid-gas ejector connected to the other side of the pump having a gas inlet connected to a source of an evacuated gaseous medium, comprising:

a chamber for supersonic flow conversion having one end connected to an outlet from the liquid-gas ejector and another end connected to the separator; and wherein said chamber includes a means for diverging stepwise in a flow direction.

5. The unit according to claim 4, wherein the one end of said chamber for supersonic flow conversion is fastened directly to one end of a mixing chamber mounted in the liquid-gas ejector.

6. The unit according to claim 4, wherein the other end of the chamber for supersonic flow conversion is fastened directly to an inlet of the separator.

7. The unit according to claim 4, wherein said means for diverging stepwise in a flow direction comprises a first step section and a conjugated second step section wherein a ratio of the cross-sectional area of said second step section to the cross-sectional area of said first step section ranges from 1.05 to 10, and a length of said second step section is not more than $\sqrt{12\ S}$, wherein S is the cross-sectional area of said first step section.

8. A pumping-ejector unit, including a separator, a pump connected by one side to the separator, and a liquid-gas ejector connected to the other side of the pump having a gas inlet connected to a source of an evacuated gaseous medium, comprising:

a chamber including a means for supersonic flow conversion having one end connected to an outlet from the liquid-gas ejector and another end connected to the separator; and wherein the liquid-gas ejector includes, mounted in the liquid-gas ejector, a motive liquid distribution chamber connected to a plurality of nozzles, a receiving chamber connected to the plurality of nozzles, and a plurality of mixing chambers coaxial to the respective plurality of nozzles.

9. The unit according to claim 8, wherein said chamber including said means for supersonic flow conversion is mounted, one each, to the plurality of mixing chambers.

10. The unit according to claim 8, wherein the liquid-gas ejector includes a discharge chamber connected to an outlet of the plurality of mixing chambers, and wherein said chamber including said means for supersonic flow conversion is fastened directly to an outlet from the discharge chamber.

11. The unit according to claim 8, wherein said chamber including said means for supersonic flow conversion comprises a first step section and a conjugated second step section wherein a ratio of the cross-sectional area of said second step section to the cross-sectional area of said first step section ranges from 1.05 to 10, and a length of said second step section is not more than $\sqrt{12\ S}$, wherein S is the cross-sectional area of said first step section.

* * * * *